US006732408B2

(12) United States Patent
Wu

(10) Patent No.: US 6,732,408 B2
(45) Date of Patent: May 11, 2004

(54) SPRING HINGE STRUCTURE

(76) Inventor: Chien-Chen Wu, P.O. Box 55-124, Taichung (TW)

( * ) Notice: Subject to any disclaimer, the term of this patent is extended or adjusted under 35 U.S.C. 154(b) by 86 days.

(21) Appl. No.: 10/073,031

(22) Filed: Feb. 12, 2002

(65) Prior Publication Data

US 2003/0014839 A1 Jan. 23, 2003

(30) Foreign Application Priority Data

Jul. 17, 2001 (TW) ..... 90212217 U

(51) Int. Cl.[7] ..... E05F 1/12
(52) U.S. Cl. ..... 16/298; 16/301; 16/273
(58) Field of Search ..... 16/298, 273, 299, 16/301, 308, DIG. 33, DIG. 39, 374

(56) References Cited

U.S. PATENT DOCUMENTS 3,921,225 A * 11/1975 Suska ..... 16/273
3,965,533 A * 6/1976 Frohlich ..... 16/300
4,419,788 A * 12/1983 Prout ..... 16/300
4,583,262 A * 4/1986 Werner ..... 16/300
4,756,051 A * 7/1988 Shy ..... 16/50
5,048,155 A * 9/1991 Hwang ..... 16/301
5,075,928 A * 12/1991 Bobrowski ..... 16/273
5,463,795 A * 11/1995 Carlson et al. ..... 16/273
6,460,220 B1 * 10/2002 Jackson ..... 16/285

FOREIGN PATENT DOCUMENTS

GB 2166796 A * 11/1984

* cited by examiner

*Primary Examiner*—Gary Estremsky
*Assistant Examiner*—Mark Williams

(57) ABSTRACT

A spring hinge structure includes a first hinge plate, a second hinge plate, and a restoring control device. The restoring control device includes an upper spindle mounted in the upper shaft tube of the first hinge plate, a lower spindle mounted in the lower shaft tube of the first hinge plate, and a spring mounted in the elongated shaft tube of the second hinge plate. A pair of juxtaposed T-shaped mounting rings made of composite plastic material are mounted between the upper shaft tube of the first hinge plate and the elongated shaft tube of the second hinge plate, and are mounted between the lower shaft tube of the first hinge plate and the elongated shaft tube of the second hinge plate respectively.

14 Claims, 9 Drawing Sheets

SPRING HINGE STRUCTURE

BACKGROUND OF THE INVENTION

1. Field of the Invention

The present invention relates to a spring hinge structure, and more particularly to a spring hinge structure, wherein the noise produced during the rotation process may be reduced, and the lifetime of the spring hinge structure may be increased.

2. Description of the Related Art

A conventional spring hinge structure in accordance with the prior art shown in FIGS. 1–4 comprises a first hinge plate 2, a second hinge plate 3, and a restoring control device 4. The first hinge plate 2 is made of metallic material, and is fixed on a door frame (not shown). The first hinge plate 2 has a first side provided with a blade 21, and a second side provided with an upper shaft tube 22 and a lower shaft tube 23 spaced from each other. The blade 21 of the first hinge plate 2 is formed with multiple joint holes 211, so that the blade 21 of the first hinge plate 2 may be locked on the door frame. The upper shaft tube 22 is formed with an arcuate slot 221 for passage of an insertion pin 413. The second hinge plate 3 is made of metallic material, and is fixed on a door plate (not shown). The second hinge plate 3 has a first side provided with a blade 31, and a second side provided with an elongated shaft tube 32 mounted between the upper shaft tube 22 and the lower shaft tube 23. The blade 31 of the second hinge plate 3 is formed with multiple joint holes 311, so that the blade 31 of the second hinge plate 3 may be locked on the door plate. The elongated shaft tube 32 of the second hinge plate 3 has a lower portion formed with a positioning hole 321 for passage of a positioning pin 423. Two washers 33 made of plastic material are mounted between the elongated shaft tube 32 of the second hinge plate 3 and the upper shaft tube 22 and the lower shaft tube 23.

The restoring control device 4 includes an upper spindle 41 mounted in the upper shaft tube 22 of the first hinge plate 2, a lower spindle 42 mounted in the lower shaft tube 23 of the first hinge plate 2, and a spring 43 mounted in the elongated shaft tube 32 of the second hinge plate 3. The upper spindle 41 has a first end provided with a fixing seat 411 secured in a first end of the spring 4, and the lower spindle 42 has a first end provided with a fixing seat 421 secured in a second end of the spring 4. The fixing seat 411 of the upper spindle 41 is formed with a positioning slit 4111 for securing the spring leg 431 formed on the first end of the spring 4, and the fixing seat 421 of the lower spindle 42 is formed with a positioning slit 4211 for securing the spring leg 431 formed on the second end of the spring 4. The upper spindle 41 has a second end formed with multiple adjusting holes 412 for insertion of the insertion pin 413. The lower spindle 42 is formed with a positioning hole 422 located adjacent to the fixing seat 421 of the lower spindle 42 for insertion of the positioning pin 423.

As shown in FIG. 2, an adjusting bar 5 may be inserted through the arcuate slot 221 into one of the adjusting holes 412 to rotate the upper spindle 41 which twists the spring 43 to have a determined restoring torque. Then, the insertion pin 413 may be inserted through the arcuate slot 221 into one of the adjusting holes 412. Thus, the door has an automatic restoring function.

However, it needs to drill the adjusting holes 412 and the positioning hole 422 in the upper spindles 41 and 42 made of metal, and it needs to form the positioning slit 4111 and 4211 in the fixing seat 411 and 421, thereby increasing the cost of fabrication. In addition, the insertion pin 413 is easily detached from the arcuate slot 221. Further, the weight of the door plate exerted on the elongated shaft tube 32 of the second hinge plate 3 and the upper shaft tube 22 and the lower shaft tube 23 of the first hinge plate 2 is applied on the washers 33, so that the washers are easily worn out during long-term utilization, thereby increasing the noise produced during the rotation process. Further, the upper and lower spindles 41 and 42 and the upper and lower shaft tubes 22 and 23 are made of metal, so that the noise is easily produced during the rotation process.

SUMMARY OF THE INVENTION

The present invention has arisen to mitigate and/or obviate the disadvantage of the conventional spring hinge structure.

The primary objective of the present invention is to provide a spring hinge structure, wherein the noise produced during the rotation process may be reduced, and the lifetime of the spring hinge structure may be increased.

In accordance with the present invention, there is provided a spring hinge structure, comprising a first hinge plate, a second hinge plate, and a restoring control device, wherein:

the first hinge plate is provided with an upper shaft tube and a lower shaft tube spaced from each other, the second hinge plate is provided with an elongated shaft tube mounted between the upper shaft tube and the lower shaft tube, the restoring control device includes an upper spindle mounted in the upper shaft tube of the first hinge plate, a lower spindle mounted in the lower shaft tube of the first hinge plate, and a spring mounted in the elongated shaft tube of the second hinge plate, the upper spindle has a first end provided with a fixing seat secured in a first end of the spring, the lower spindle has a first end provided with a fixing seat secured in a second end of the spring, a pair of juxtaposed T-shaped mounting rings are mounted between the upper shaft tube of the first hinge plate and the elongated shaft tube of the second hinge plate, and are mounted between the lower shaft tube of the first hinge plate and the elongated shaft tube of the second hinge plate respectively, each of the T-shaped mounting rings includes an annular contact ring, the contact rings of the T-shaped mounting rings are juxtaposed with each other, the contact rings of the T-shaped mounting rings are clamped between the upper shaft tube of the first hinge plate and the elongated shaft tube of the second hinge plate, and are clamped between the lower shaft tube of the first hinge plate and the elongated shaft tube of the second hinge plate.

Further benefits and advantages of the present invention will become apparent after a careful reading of the detailed description with appropriate reference to the accompanying drawings.

DETAILED DESCRIPTION OF THE INVENTION

Figure 1:
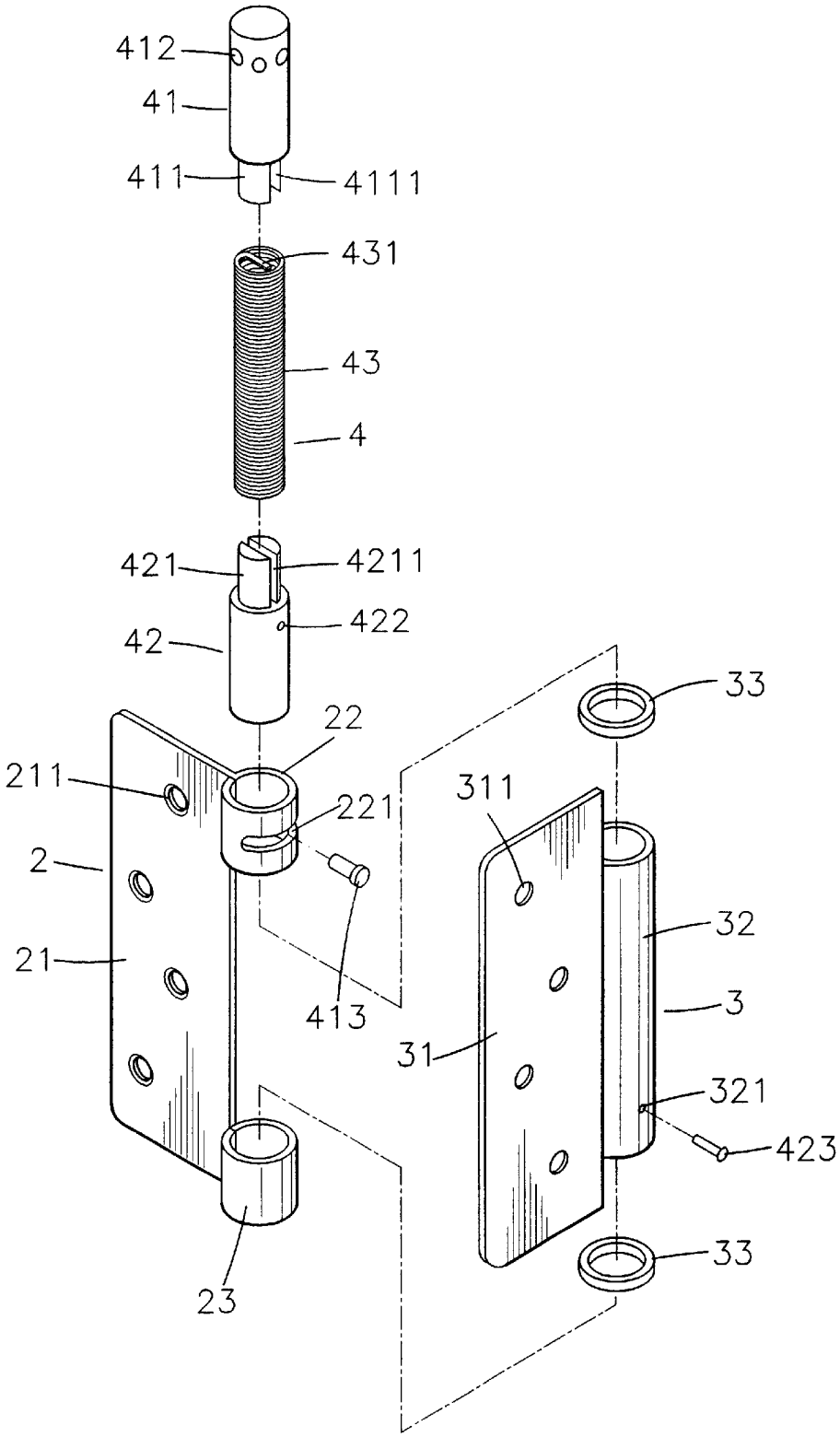
FIG. 1 PRIOR ART
FIG. 1 is an exploded perspective view of a conventional spring hinge structure in accordance with the prior art.
Figure 2:
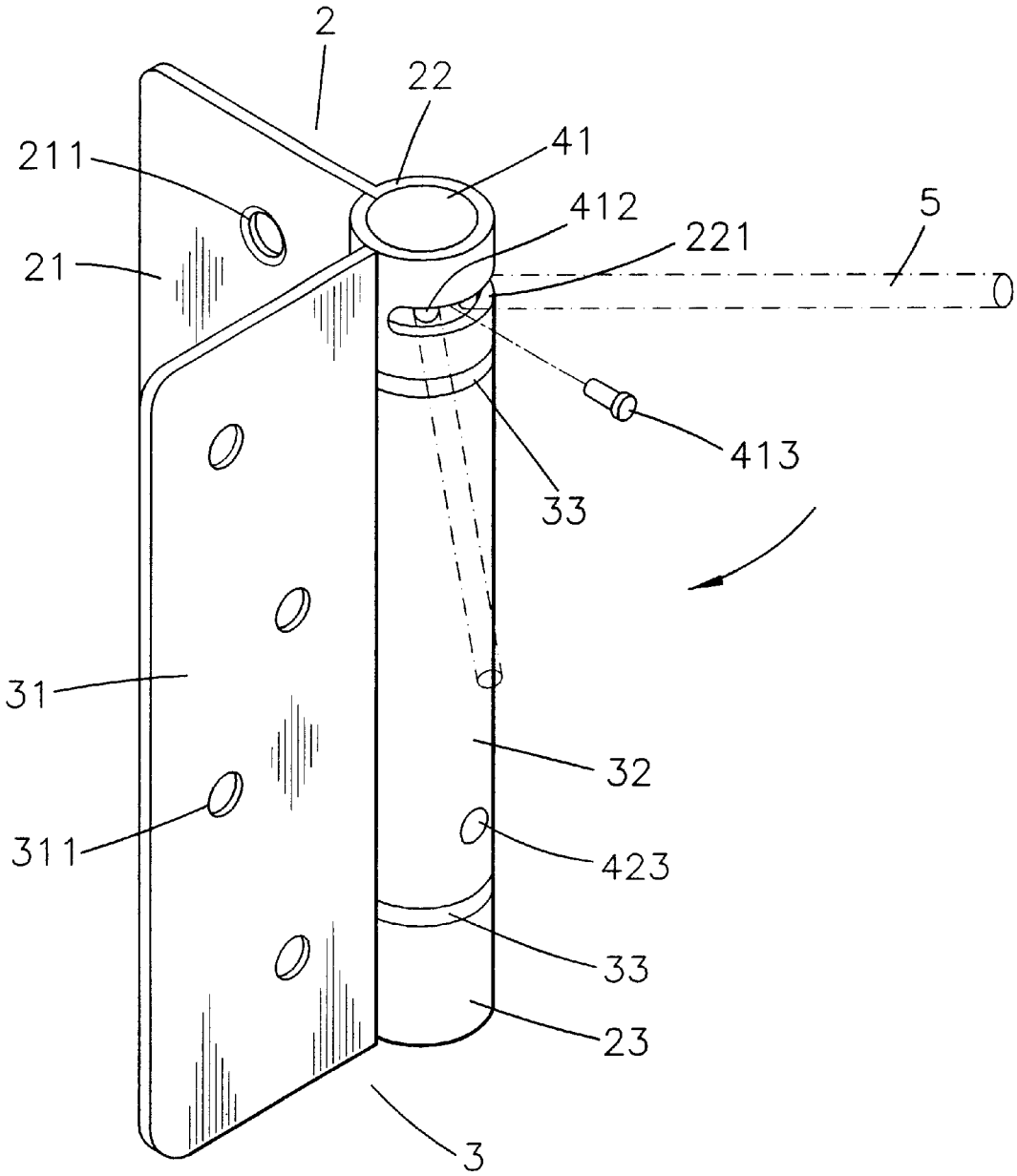
FIG. 2 PRIOR ART
FIG. 2 is a perspective assembly view of the conventional spring hinge structure as shown in FIG. 1.
Figure 3:
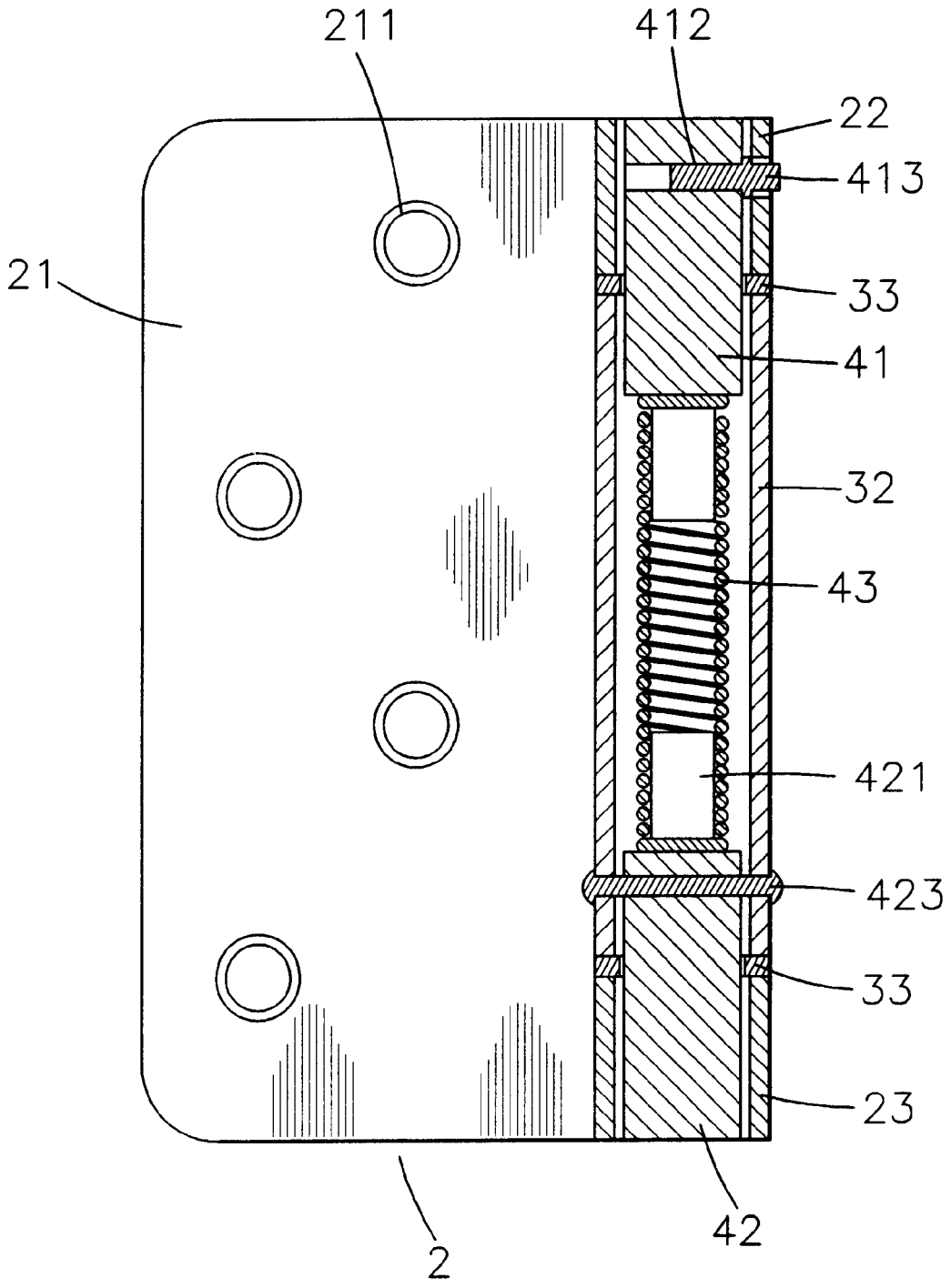
FIG. 3 PRIOR ART
FIG. 3 is a side plan cross-sectional view of the conventional spring hinge structure as shown in FIG. 2.
Figure 4:
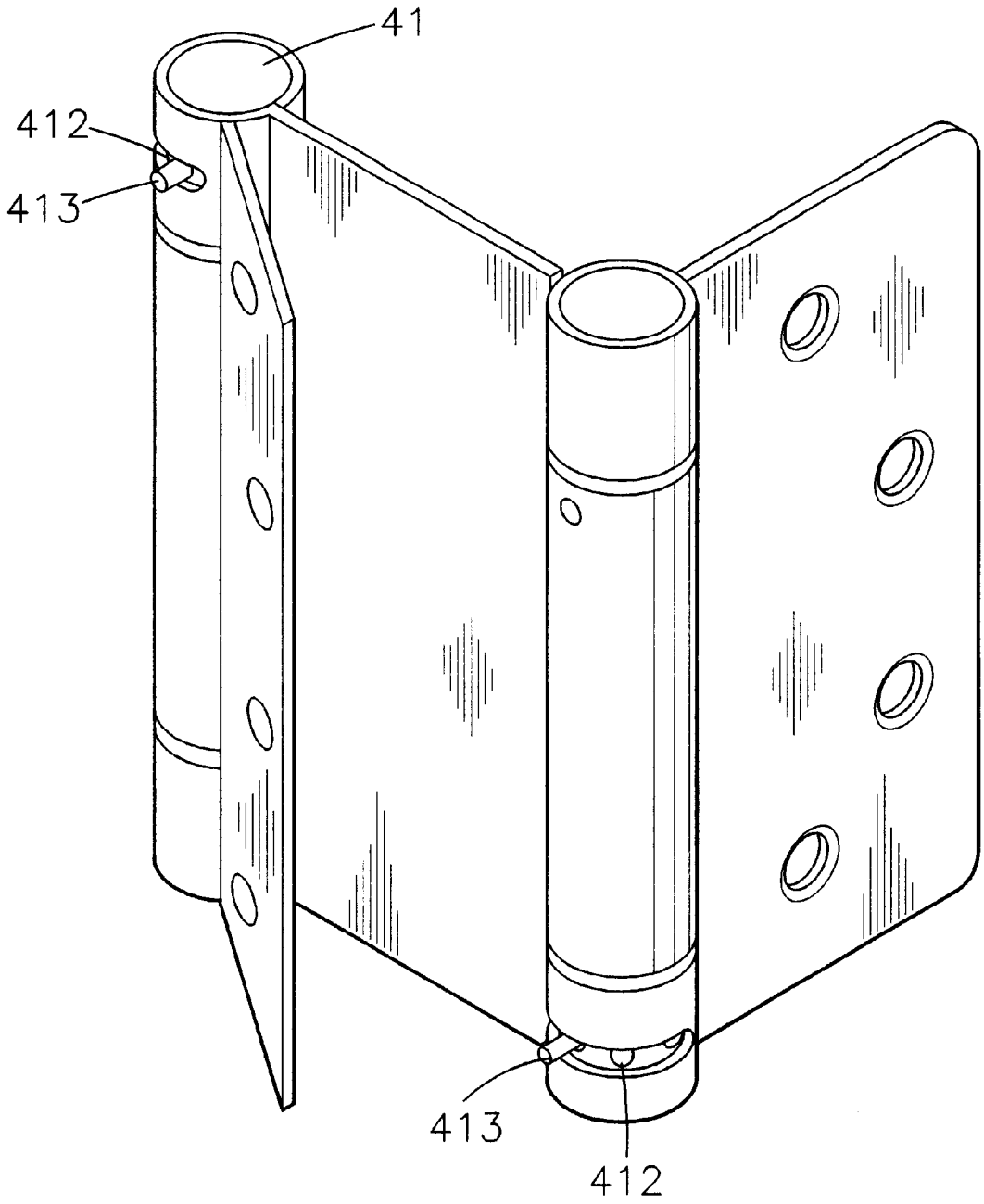
FIG. 4 PRIOR ART
FIG. 4 is a perspective view of another embodiment of a conventional spring hinge structure in accordance with the prior art.
Figures 5, 5A, 5B:
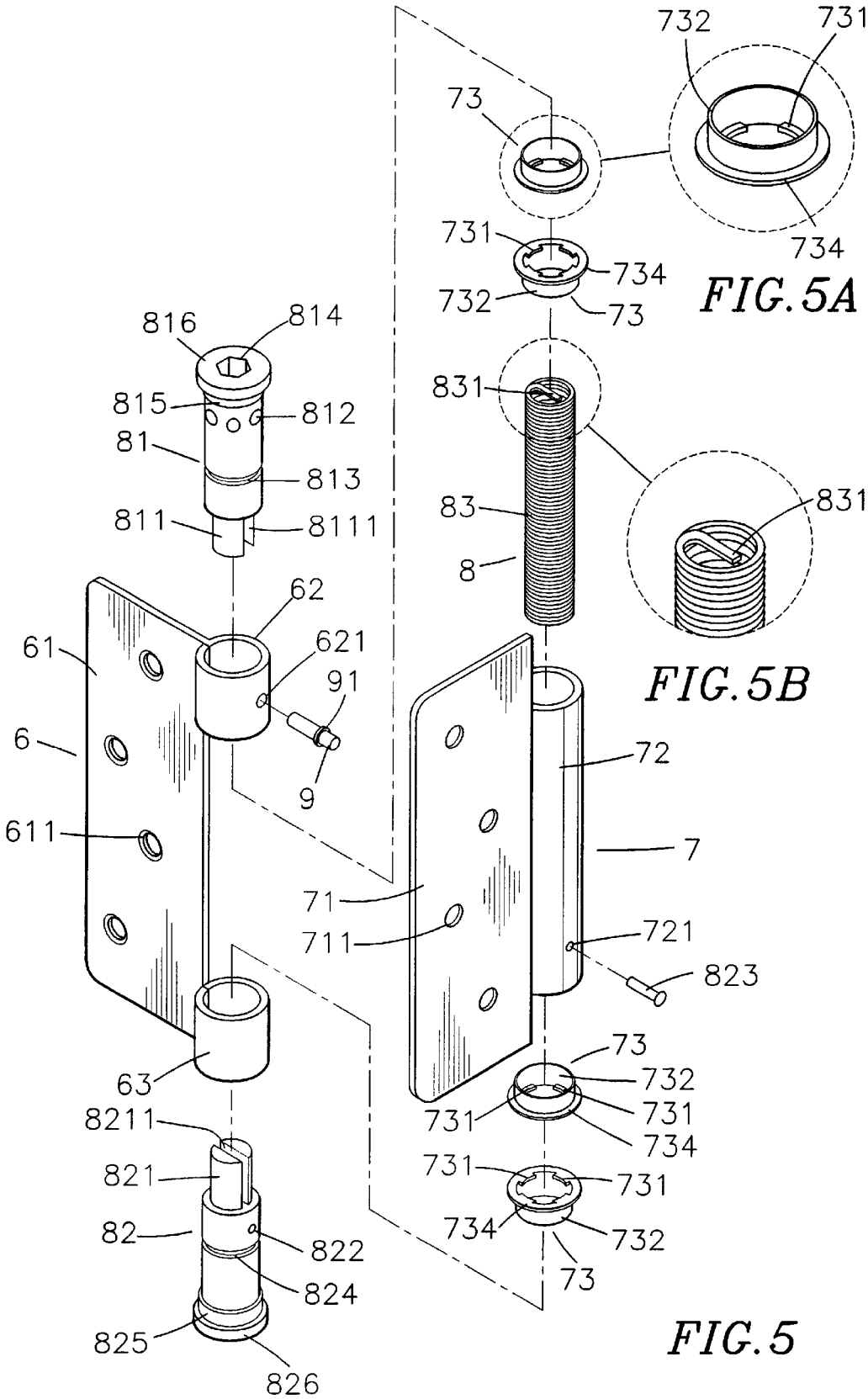
FIG. 5 is an exploded perspective view of a spring hinge structure in accordance with a preferred embodiment of the present invention.
FIG. 5A is a perspective view of a mounting ring of the spring hinge structure as shown in FIG. 5.
FIG. 5B is a partially cut-away perspective view of a spring of the spring hinge structure as shown in FIG. 5.
Figure 6:
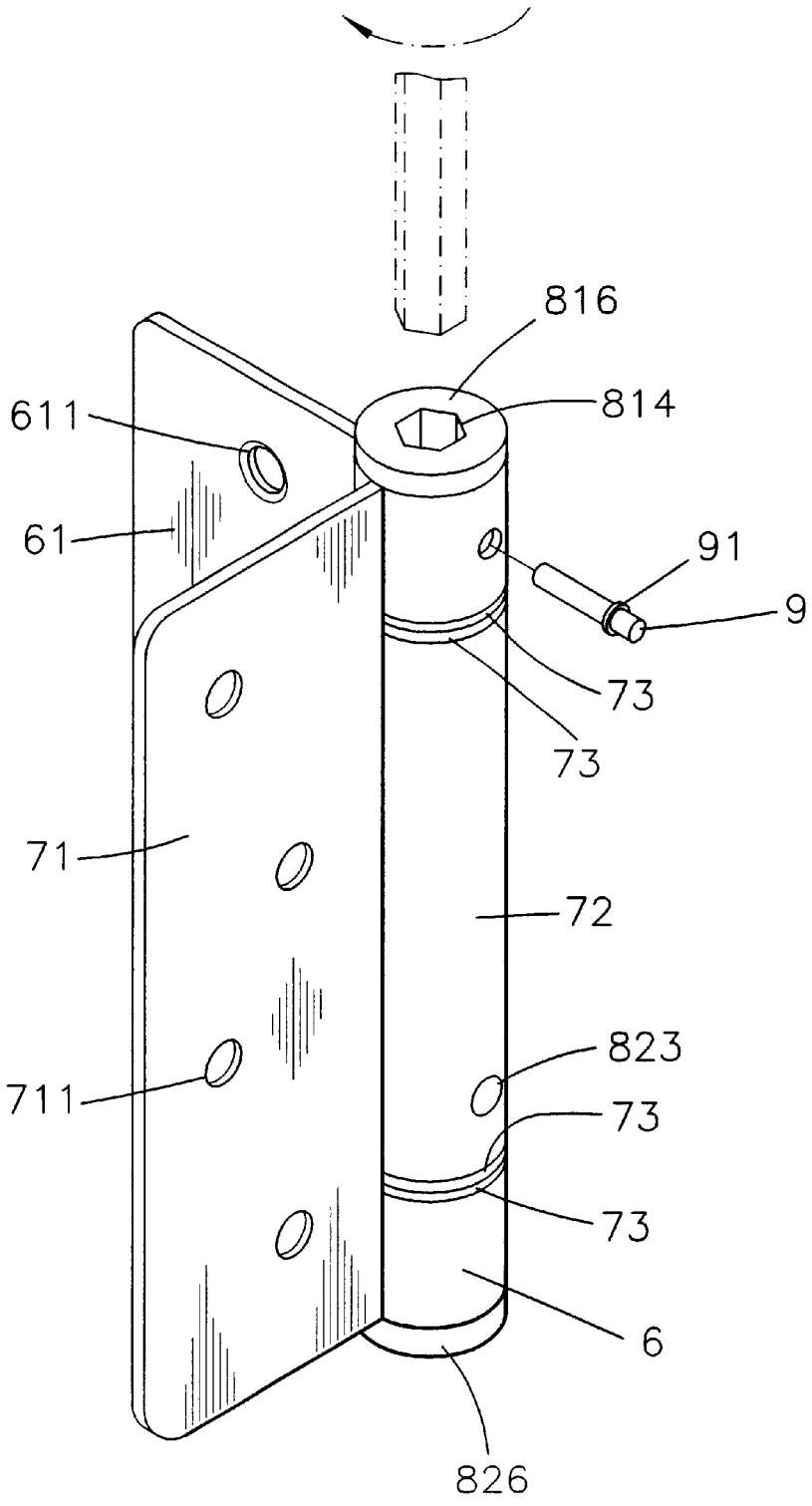
FIG. 6 is a perspective view of a spring hinge structure in accordance with a preferred embodiment of the present invention.
Figure 7:
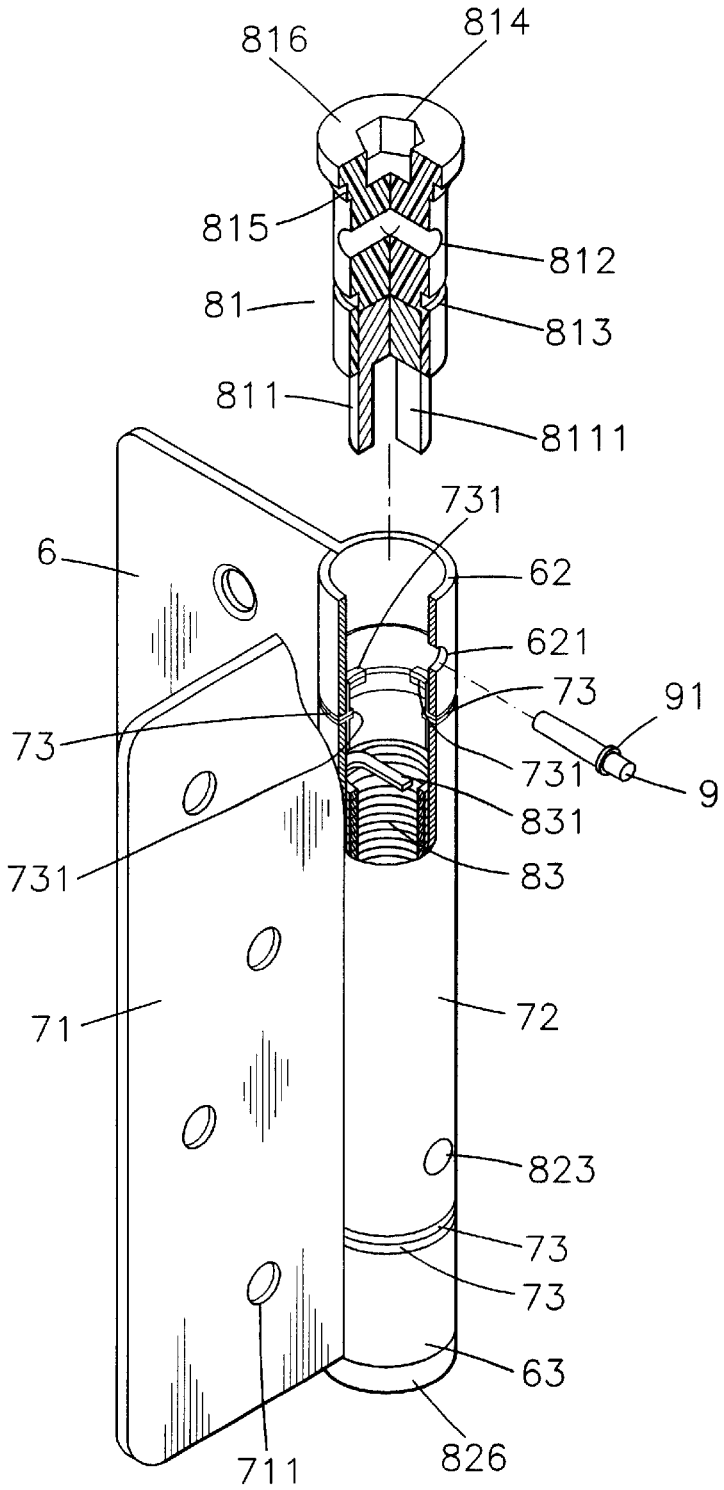
FIG. 7 is a partially cut-away exploded cross-sectional view of the spring hinge structure as shown in FIG. 6.
Figure 8:
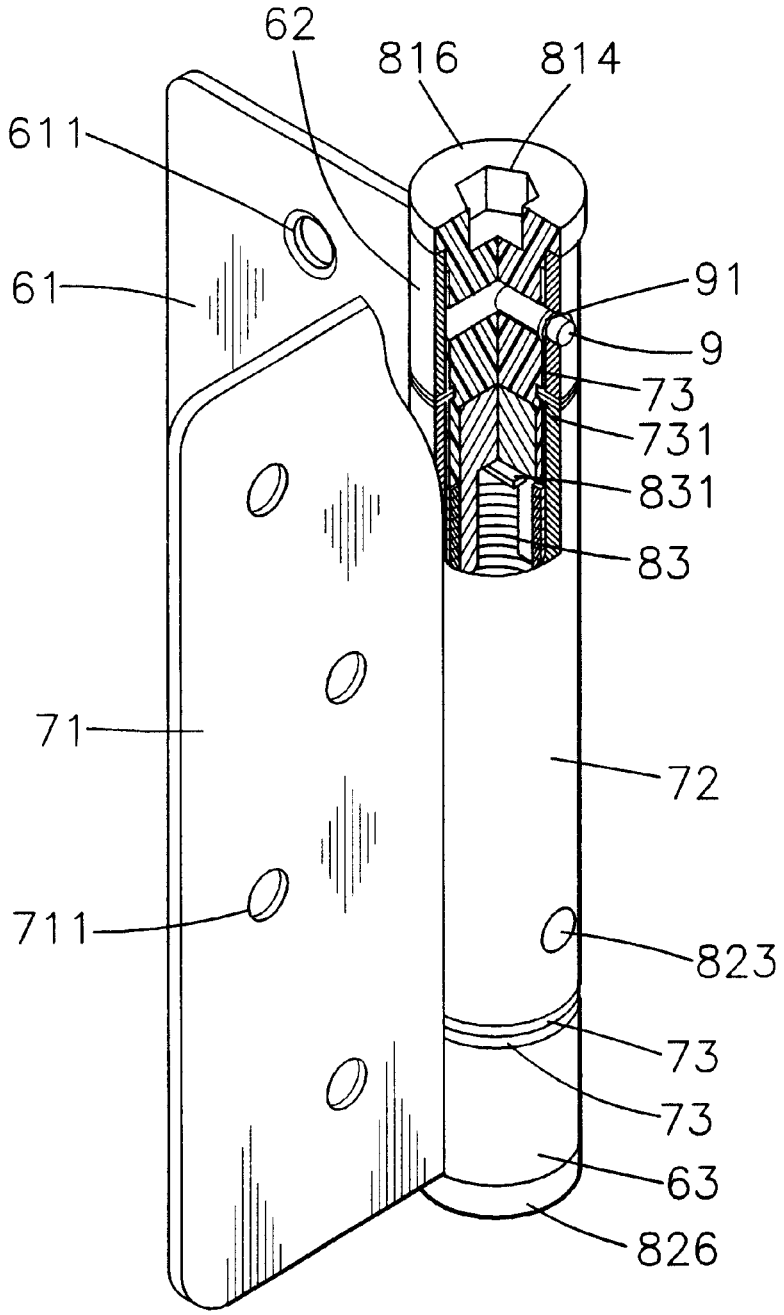
FIG. 8 is a partially cut-away cross-sectional view of the spring hinge structure as shown in FIG. 6.
Figure 9:
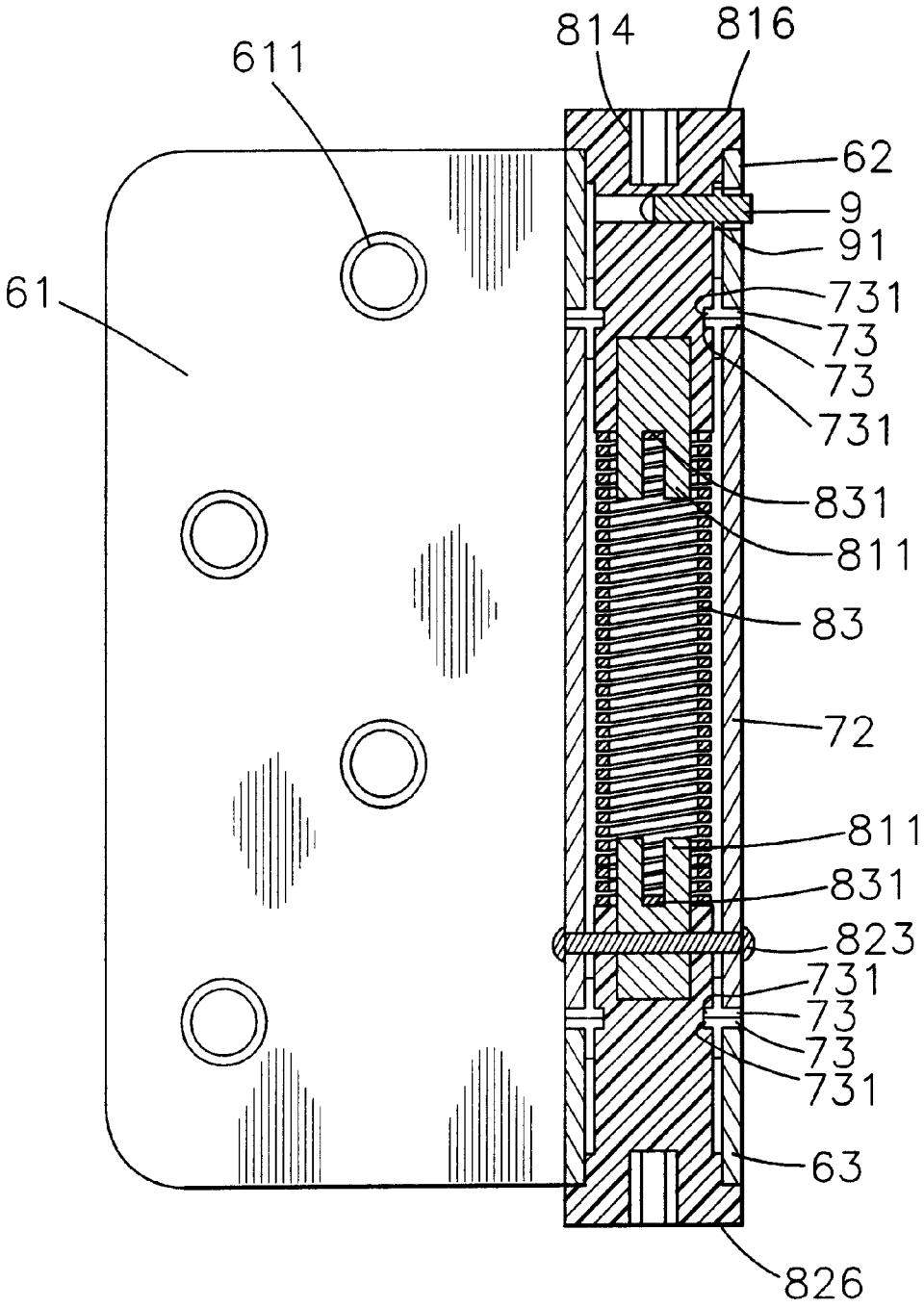
FIG. 9 is a side plan cross-sectional view of the spring hinge structure as shown in FIG. 6.

Referring to FIGS. 5–9, a spring hinge structure in accordance with a preferred embodiment of the present invention comprises a first hinge plate 6, a second hinge plate 7, and a restoring control device 8.

The first hinge plate 6 is made of metallic material, and is fixed on a door frame (not shown). The first hinge plate 6 has a first side provided with a blade 61, and a second side provided with an upper shaft tube 62 made of metal and a lower shaft tube 63 made of metal spaced from each other. The blade 61 of the first hinge plate 6 is formed with multiple joint holes 611, so that the blade 61 of the first hinge plate 6 may be locked on the door frame.

The second hinge plate 7 is made of metallic material, and is fixed on a door plate (not shown). The second hinge plate 7 has a first side provided with a blade 71, and a second side provided with an elongated shaft tube 72 made of metal mounted between the upper shaft tube 62 and the lower shaft tube 63. The blade 71 of the second hinge plate 7 is formed with multiple joint holes 711, so that the blade 71 of the second hinge plate 7 may be locked on the door plate. The elongated shaft tube 72 of the second hinge plate 7 has a lower portion formed with a positioning hole 721.

The restoring control device 8 includes an upper spindle 81 mounted in the upper shaft tube 62 of the first hinge plate 6, a lower spindle 82 mounted in the lower shaft tube 63 of the first hinge plate 6, and a spring 83 mounted in the elongated shaft tube 72 of the second hinge plate 7.

The upper spindle 81 has a first end provided with a fixing seat 811 secured in a first end of the spring 8, the lower spindle 82 has a first end provided with a fixing seat 821 secured in a second end of the spring 8. The fixing seat 811 of the upper spindle 81 is formed with a positioning slit 8111 for securing the spring leg 831 formed on the first end of the spring 8, and the fixing seat 821 of the lower spindle 82 is formed with a positioning slit 8211 for securing the spring leg 831 formed on the second end of the spring 8.

The upper spindle 81 has a second end provided with a pivot insertion section 815 pivotally mounted in the upper shaft tube 62 of the first hinge plate 6, and an enlarged cover head 816 rested on an outer end face of the upper shaft tube 62 of the first hinge plate 6, so that when the upper spindle 81 is forced into the upper shaft tube 62 of the first hinge plate 6, the enlarged cover head 816 may be rested on the outer end face of the upper shaft tube 62 of the first hinge plate 6, so as to provide a stopping effect, thereby preventing the upper spindle 81 from being excessively inserted into the upper shaft tube 62 of the first hinge plate 6, and preventing the fixing seat 811 of the upper spindle 81 from compressing the spring leg 831 on the first end of the spring 8.

The lower spindle 82 has a second end provided with a pivot insertion section 825 pivotally mounted in the lower shaft tube 63 of the first hinge plate 6, and an enlarged cover head 826 rested on an outer end face of the lower shaft tube 63 of the first hinge plate 6, so that when the lower spindle 82 is forced into the lower shaft tube 63 of the first hinge plate 6, the enlarged cover head 826 may be rested on the outer end face of the lower shaft tube 63 of the first hinge plate 6, so as to provide a stopping effect, thereby preventing the lower spindle 82 from being excessively inserted into the lower shaft tube 63 of the first hinge plate 6, and preventing the fixing seat 821 of the lower spindle 82 from compressing the spring leg 831 on the second end of the spring 8.

The upper spindle 81 is formed with multiple adjusting holes 812 located adjacent to the pivot insertion section 815, and the upper shaft tube 62 of the first hinge plate 6 is formed with a positioning insertion hole 621. An insertion pin 9 is extended through the positioning insertion hole 621 of the upper shaft tube 62 of the first hinge plate 6, and is inserted into one of the adjusting holes 812 of the upper spindle 81. The insertion pin 9 is provided with an annular positioning flange 91 that may be passed through the positioning insertion hole 621 of the upper shaft tube 62 of the first hinge plate 6, and may be clamped between an outer wall of the upper spindle 81 and an inner wall of the upper shaft tube 62 of the first hinge plate 6, thereby preventing from detachment of the insertion pin 9, so that the upper spindle 81 may be positioned efficiently.

The cover head 816 of the upper spindle 81 is formed with a hexagonal insertion recess 814, so that a tool may be inserted into the insertion recess 814 of the cover head 816 of the upper spindle 81, to rotate the upper spindle 81, thereby facilitating the insertion pin 9 from being inserted into one of the adjusting holes 812 of the upper spindle 81, so as to adjust the restoring torque of the door when the door is opened or closed.

The lower spindle 82 is formed with a positioning hole 822 located adjacent to the fixing seat 821 of the lower spindle 82. A positioning pin 823 is extended through the positioning hole 721 of the elongated shaft tube 72 of the second hinge plate 7, and is inserted into the positioning hole 822 of the lower spindle 82, so that the elongated shaft tube 72 of the second hinge plate 7 may be combined with the lower spindle 82.

The upper spindle 81 and the lower spindle 82 of the restoring control device 8 are made of composite plastic material, and are integrally with the fixing seat 811 and the fixing seat 821 made of a metallic material respectively by a plastic injection molding process.

A pair of juxtaposed T-shaped mounting rings 73 are mounted between the upper shaft tube 62 of the first hinge plate 6 and the elongated shaft tube 72 of the second hinge plate 7, and are mounted between the lower shaft tube 63 of the first hinge plate 6 and the elongated shaft tube 72 of the second hinge plate 7 respectively.

Each of the two T-shaped mounting rings 73 is made of composite plastic material, and includes a sleeve 732, and an annular contact ring 734 protruded outward from an outer periphery of the sleeve 732. The contact rings 734 of the two T-shaped mounting rings 73 are juxtaposed with each other.

In the two juxtaposed T-shaped mounting rings 73 mounted between the upper shaft tube 62 of the first hinge plate 6 and the elongated shaft tube 72 of the second hinge plate 7, the sleeve 732 of one of the two juxtaposed T-shaped mounting rings 73 is mounted between the upper spindle 81 and the upper shaft tube 62 of the first hinge plate 6, and the sleeve 732 of the other of the two juxtaposed T-shaped mounting rings 73 is mounted between the upper spindle 81 and the elongated shaft tube 72 of the second hinge plate 7, while the contact rings 734 of the two T-shaped mounting rings 73 are clamped between the upper shaft tube 62 of the first hinge plate 6 and the elongated shaft tube 72 of the second hinge plate 7. Thus, when the elongated shaft tube 72 of the second hinge plate 7 is pivoted relative to the upper shaft tube 62 of the first hinge plate 6, the contact rings 734 of the two T-shaped mounting rings 73 may be rubbed relative to each other.

In the two juxtaposed T-shaped mounting rings 73 mounted between the lower shaft tube 63 of the first hinge plate 6 and the elongated shaft tube 72 of the second hinge plate 7, the sleeve 732 of one of the two juxtaposed T-shaped mounting rings 73 is mounted between the lower spindle 82 and the lower shaft tube 63 of the first hinge plate 6, and the sleeve 732 of the other of the two juxtaposed T-shaped mounting rings 73 is mounted between the lower spindle 81 and the elongated shaft tube 72 of the second hinge plate 7, while the contact rings 734 of the two T-shaped mounting rings 73 are clamped between the lower shaft tube 63 of the first hinge plate 6 and the elongated shaft tube 72 of the second hinge plate 7. Thus, when the elongated shaft tube 72 of the second hinge plate 7 is pivoted relative to the lower shaft tube 63 of the first hinge plate 6, the contact rings 734 of the two T-shaped mounting rings 73 may be rubbed relative to each other.

Thus, during the opening and closing process of the door, the elongated shaft tube 72 of the second hinge plate 7, and the upper shaft tube 62 and the lower shaft tube 63 of the first hinge plate 6 are isolated by the contact rings 734 of the T-shaped mounting rings 73, thereby preventing the elongated shaft tube 72 of the second hinge plate 7 from rubbing the upper shaft tube 62 and the lower shaft tube 63 of the first hinge plate 6, so that the noise produced during the pivotal process may be reduced largely, and the lifetime of the spring hinge structure may be greatly increased.

The upper spindle 81 has an outer wall formed with an annular positioning groove 813, and the lower spindle 82 has an outer wall formed with an annular positioning groove 824. Each of the T-shaped mounting rings 73 has an inner wall provided with multiple lugs 731 secured in the annular positioning groove 813 of the upper spindle 81 and secured in the annular positioning groove 824 of the lower spindle 82, thereby positioning the upper spindle 81 and the lower spindle 82.

Accordingly, the spring hinge structure in accordance with a preferred embodiment of the present invention has the following advantages.

The upper spindle 81 the lower spindle 82 of the restoring control device 8 are made of composite plastic material, and the fixing seat 811 and the fixing seat 821 made of metallic material. The upper spindle 81 the lower spindle 82 of the restoring control device 8 are integrally with the fixing seat 811 and the fixing seat 821 respectively by a plastic injection molding process, while the adjusting holes 812 are directly formed in the upper spindle 81 and the positioning hole 822 is directly formed in the lower spindle 82 during the plastic injection molding process, without having to drill bores in the upper and lower spindles as disclosed in the conventional hinge structure, thereby decreasing the cost of fabrication.

In addition, when the upper spindle 81 and the lower spindle 82 made of composite plastic material are mounted on the upper and lower shaft tubes 62 and 63 made of metallic material, the noise produced during the rotation process may be reduced greatly.

Further, the sleeves 732 and the contact rings 734 of the T-shaped mounting rings 73 made of composite plastic material may provide a buffer isolation effect between the upper spindle 81, the upper shaft tube 62 of the first hinge plate 6, the elongated shaft tube 72 of the second hinge plate 7, the lower shaft tube 63 of the first hinge plate 6, and the lower spindle 82, thereby preventing from producing noise during the rotation process.

Further, each of the T-shaped mounting rings 73 has an inner wall provided with multiple lugs 731 secured in the annular positioning groove 813 of the upper spindle 81 and secured in the annular positioning groove 824 of the lower spindle 82, so that the upper spindle 81 and the lower spindle 82 may be positioned at the same axis.

Further, the weight of the door plate exerted on the elongated shaft tube 72 of the second hinge plate 7 and the upper shaft tube 62 and the lower shaft tube 63 of the first hinge plate 6 may be counteracted by the sleeves 732 of the T-shaped mounting rings 73 made of composite plastic material, so that the upper spindle 81 and the lower spindle 82 may be maintained at the same axis efficiently, thereby increasing the lifetime of the spring hinge structure, and so that the noise produced during the rotation process may be reduced.

Further, the cover head 816 of the upper spindle 81 is formed with a hexagonal insertion recess 814, so that a tool may be inserted into the insertion recess 814 of the cover head 816 of the upper spindle 81 to rotate the upper spindle 81 which twists the spring 8 to have a determined restoring torque, thereby facilitating the insertion pin 9 from being inserted into one of the adjusting holes 812 of the upper spindle 81 through the positioning insertion hole 621 of the upper shaft tube 62 of the first hinge plate 6, so as to adjust the restoring torque of the door when the door is opened or closed.

Further, the insertion pin 9 is provided with an annular positioning flange 91 that may be passed through the positioning insertion hole 621 of the upper shaft tube 62 of the first hinge plate 6, and may be clamped between an outer wall of the upper spindle 81 and an inner wall of the upper shaft tube 62 of the first hinge plate 6, thereby preventing from detachment of the insertion pin 9.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A spring hinge structure, comprising a first hinge plate, a second hinge plate, and a restoring control device, wherein:

the first hinge plate is provided with an upper shaft tube and a lower shaft tube spaced from each other, the second hinge plate is provided with an elongated shaft tube mounted between the upper shaft tube and the lower shaft tube, the restoring control device includes an upper spindle mounted in the upper shaft tube of the first hinge plate, a lower spindle mounted in the lower shaft tube of the first hinge plate, and a spring mounted in the elongated shaft tube of the second hinge plate, the upper spindle has a first end provided with a fixing seat secured in a first end of the spring, the lower spindle has a first end provided with a fixing seat secured in a second end of the spring, a first pair of juxtaposed T-shaped mounting rings are mounted between the upper shaft tube of the first hinge plate and the elongated shaft tube of the second hinge plate, and a second pair of juxtaposed T-shaped mounting rings are mounted between the lower shaft tube of the first hinge plate and the elongated shaft tube of the second hinge plate respectively, each of the T-shaped mounting rings includes an annular contact ring, the contact rings of the T-shaped mounting rings are juxtaposed with each other, the contact rings of the first pair of T-shaped mounting rings are clamped between the upper shaft tube of the first hinge plate and the elongated shaft tube of the second hinge plate, and the contact rings of the second pair of T-shaped mounting rings are clamped between the lower shaft tube of the first hinge plate and the elongated shaft tube of the second hinge plate; and the upper spindle has an outer wall formed with an annular positioning groove, the lower spindle has an outer wall formed with an annular positioning groove, and each of the T-shaped mounting rings has an inner wall provided with multiple lugs secured in the annular positioning groove of the upper spindle and secured in the annular positioning groove of the lower spindle.

2. The spring hinge structure in accordance with claim 1, wherein the upper spindle has a second end provided with a pivot insertion section pivotally mounted in the upper shaft tube of the first hinge plate, and an enlarged cover head rested on an outer end face of the upper shaft tube of the first hinge plate, the lower spindle has a second end provided with a pivot insertion section pivotally mounted in the lower shaft tube of the first hinge plate, and an enlarged cover head rested on an outer end face of the lower shaft tube of the first hinge plate, the upper spindle is formed with multiple adjusting holes located adjacent to the pivot insertion section, the upper shaft tube of the first hinge plate is formed with a positioning insertion hole, an insertion pin is extended through the positioning insertion hole of the upper shaft tube of the first hinge plate, and is inserted into one of the adjusting holes of the upper spindle.

3. The spring hinge structure in accordance with claim 2, wherein the insertion pin is provided with an annular positioning flange that is passed through the positioning insertion hole of the upper shaft tube of the first hinge plate, and is clamped between an outer wall of the upper spindle and an inner wall of the upper shaft tube of the first hinge plate, thereby preventing from detachment of the insertion pin.

4. The spring hinge structure in accordance with claim 2, wherein the cover head of the upper spindle is formed with a hexagonal insertion recess, so that a tool may be inserted into the insertion recess of the cover head of the upper spindle.

5. The spring hinge structure in accordance with claim 1, wherein the elongated shaft tube of the second hinge plate has a lower portion formed with a positioning hole, the lower spindle is formed with a positioning hole located adjacent to the fixing seat of the lower spindle, and the spring hinge structure further comprising a positioning pin extended through the positioning hole of the elongated shaft tube of the second hinge plate, and is inserted into the positioning hole of the lower spindle, so that the elongated shaft tube of the second hinge plate may be combined with the lower spindle.

6. The spring hinge structure in accordance with claim 1, wherein the first hinge plate is made of metallic material, and has a first side provided with a blade formed with multiple joint holes, and a second side provided with the upper shaft tube and the lower shaft tube.

7. The spring hinge structure in accordance with claim 1, wherein the second hinge plate is made of metallic material, and has a first side provided with a blade formed with multiple joint holes, and a second side provided with the elongated shaft tube.

8. The spring hinge structure in accordance with claim 1, wherein the fixing seat of the upper spindle is formed with a positioning slit for securing a spring leg formed on the first end of the spring, and the fixing seat of the lower spindle is formed with a positioning slit for securing a spring leg formed on the second end of the spring.

9. The spring hinge structure in accordance with claim 1, wherein the upper spindle is made of composite plastic material and is integrally with the fixing seat made of metallic material.

10. The spring hinge structure in accordance with claim 1, wherein the lower spindle is made of composite plastic material and is integrally with the fixing seat made of metallic material.

11. The spring hinge structure in accordance with claim 1, wherein each of the T-shaped mounting rings is made of composite plastic material.

12. The spring hinge structure in accordance with claim 1, wherein each of the T-shaped mounting rings includes a sleeve.

13. The spring hinge structure in accordance with claim 12, wherein in the first pair of juxtaposed T-shaped mounting rings mounted between the upper shaft tube of the first hinge plate and the elongated shaft tube of the second hinge plate, the sleeve of one of the first pair of juxtaposed T-shaped mounting rings is mounted between the upper spindle and the upper shaft tube of the first hinge plate, and the sleeve of the other of the first pair of juxtaposed T-shaped mounting rings is mounted between the upper spindle and the elongated shaft tube of the second hinge plate.

14. The spring hinge structure in accordance with claim 12, wherein in the second pair of juxtaposed T-shaped mounting rings mounted between the lower shaft tube of the first hinge plate and the elongated shaft tube of the second hinge plate, the sleeve of one of the second pair of juxtaposed T-shaped mounting rings is mounted between the lower spindle and the lower shaft tube of the first hinge plate, and the sleeve of the other of the second pair of juxtaposed T-shaped mounting rings is mounted between the lower spindle and the elongated shaft tube of the second hinge plate.

* * * * *